US007128490B2

(12) United States Patent
McEwan

(10) Patent No.: US 7,128,490 B2
(45) Date of Patent: Oct. 31, 2006

(54) CLEANING APPARATUS AND SYSTEM

(76) Inventor: Wayne E. McEwan, 47 Hall Rd., Barrington, NH (US) 03825

( * ) Notice: Subject to any disclaimer, the term of this patent is extended or adjusted under 35 U.S.C. 154(b) by 196 days.

(21) Appl. No.: 10/807,880

(22) Filed: Mar. 24, 2004

(65) Prior Publication Data

US 2005/0214059 A1 Sep. 29, 2005

(51) Int. Cl.
*A47B 11/00* (2006.01)

(52) U.S. Cl. ..... 401/140; 401/138; 401/289

(58) Field of Classification Search ..... 401/268, 401/282, 289, 290, 136–140, 183
See application file for complete search history.

(56) References Cited

U.S. PATENT DOCUMENTS

| | | | | |
|---|---|---|---|---|
| 864,676 | A * | 8/1907 | Nagely | 401/264 |
| 1,561,304 | A * | 11/1925 | Bell-Irving | 401/39 |
| 2,073,170 | A * | 3/1937 | Pieper | 401/138 |
| 2,432,015 | A * | 12/1947 | Hodshon | 401/138 |
| 3,135,990 | A * | 6/1964 | Bergmann et al. | 401/286 |
| 3,561,304 | A * | 2/1971 | Eagle | 82/165 |
| 6,698,961 | B1 | 3/2004 | Pollock | 401/289 |

* cited by examiner

*Primary Examiner*—Huyen Le
(74) *Attorney, Agent, or Firm*—Davis & Bujold, P.L.L.C.

(57) ABSTRACT

A combination fluid dispensing bottle and scrubbing brush. The scrubbing brush is releasably secured to the bottle by a collar which has a first passage sized to be fit over and secured to a bottle cap covering the open spout of a plastic squeeze bottle, and a second passage sized to accept and secure a handle of a scrubbing brush in relative proximity to the sidewalls of the plastic bottle. The collar comprises a separable first and second clamping pieces which can be drawn together or spread apart according to the operation of a quick release device, to respectively secure the brush to the bottle or release the brush therefrom. Also the fluid dispensing bottle and brush may be provided with communicating passageways in order to directly dispense the fluid from the bottle into direct proximity of the brush bristles.

7 Claims, 3 Drawing Sheets

CLEANING APPARATUS AND SYSTEM

FIELD OF THE INVENTION

The present invention relates generally to a cleaning device and system for cleaning any surface and more specifically to a tile grout cleaning bottle and brush combination facilitated by a clamping device in the form of a releasable collar to facilitate the replacement and interchangeability of the brush.

BACKGROUND OF THE INVENTION

There are numerous residential and commercial surfaces and materials which require cleaning. Many of these surfaces and materials are difficult to clean and require specific cleaning implements, for instance specialty shaped brushes. For professional cleaning of certain construction materials, in particular the tile grout in seams between tile, such cleaning is typically carried out manually due to the nature of the tile and grout materials. It is well known that grout, which is used to secure and fill the thin, elongate spaces or seams between tiles, or between tiles and another building material, usually fills the spaces or seams at a level below that of the plane defined by the top surface of the tile. Once properly applied between the tiles, the grout in the seam is essentially slightly depressed or sunken below the top surface of the tile, and even slightly concave in nature relative to the plane along which such tile and grout is laid.

Because of the relatively thin nature of the seam between tiles, relative to the planar tile surface, the seam and grout therein becomes a particularly difficult spot to clean. For example, on a tile floor a cleaning device such as a semi-automated sweeper, or even a conventional mop, tends to traverse the plane of the floor as defined substantially by the top surface of the tiles. The cleaning device which may adequately clean the top surface of the tiles making up the floor, can miss, i.e., pass over or span the seam, and due to the depressed, sunken and even concave nature of the grout, miss the grout completely, thus failing to clean the grout. In many cases the depressed nature of the grout even acts as a trap, ensnaring dirt and debris therein which cannot be easily cleaned. Furthermore, the porous nature of certain grouts also traps dirt and debris therein so that even if the surface of the grout is cleaned, the dirt and debris remains imbedded in the grout, and the grout appears dirty, dingy and uncleaned.

In order to properly clean grout it is generally necessary to manually apply a grout cleaning solution and then manually scrub the applied cleaning solution into the grout to lift out the imbedded dirt and debris. This operation is usually accomplished by a worker working on their hands and knees traversing the floor while applying the requisite cleaner from a bottle and then, with a separate brush, vigorously scrubbing the grout to remove the dirt and debris.

Generally, to really get tile grout clean it must be cleaned manually, and there are few alternatives. As discussed above, a worker utilizes a cleaning solution in a hand held bottle and applies a desired amount of cleaning solution to an area of grout to loosen any dirt, grime, mold or other debris located therein and then scrubs the grout with a brush. A grout cleaning brush as known in the art is generally provided with an elongate handle between about 4 to 14 inches in length and more preferably about 8 to 12 inches long. At one end of the brush a set of bristles is attached to the handle in a similar manner to that of a toothbrush. The bristles may be made of varying materials for example nylon or even metal wire bristles having various stiffnesses, but in any event, the bristles are stiff enough to provide an adequate scrubbing of the grout. However as is also known, the bristles have a finite life due to the intensity of the scrubbing which must be done to adequately clean grout and, therefore, after a certain period of time of a brush be discarded and replaced.

Bottles which are used to hold cleaning solution by the worker scrubbing the grout are also known in the art. The bottles generally hold about 6–64 ounces of cleaning solution, and being about 2 to 6 inches in diameter, and more preferably about 3 to 4 inches in diameter, can be easily held in the workers hand. It can be readily appreciated that in cleaning tile grout the cleaning solution need only be applied to the grout, rather than to the tile surface(s). In order to facilitate the appropriate dispensing of the cleaning solution only on the grout in the seam between the tiles, the bottle is provided with a nipple which has an opening at the dispensing end sized to permit only a desired about of cleaning solution out of the bottle and to apply the cleaning solution only along the grout. Too large an opening and the cleaning solution is apt to be dispensed all over the tile surfaces and cause the worker to have undertake an inordinate amount of clean up.

With the separate cleaning solution bottle and scrubbing brush as is known in the art, a worker who is cleaning floor tile grout is usually working on their hands and knees. Because of this physical working position it is necessary to have both knees on the floor, and at least one hand on the floor to support the workers upper body. The worker's other hand is then free to use the bottle, or the brush as necessary. In view of the fact that only one hand is free to perform such work, the worker must first dispense a desired amount of cleaning solution along the grout line and then put the bottle down and pick up the scrubbing brush to scrub the grout. This known method and apparatus for cleaning is greatly inefficient as the wasted motions of putting down one implement, or the other, take time and may place the necessary implements out of reach as the worker moves along the grout line scrubbing and cleaning. These inefficiencies have led workers to, for example, tape the handle of the scrubbing brush to the bottle so that the brush bristles are aligned radially outward relative to the circumference of the bottle. In this manner by using only one hand, the worker can not only dispense the cleaning solution, but can also immediately, or even simultaneously in some cases, scrub the tile grout with the brush without having to put down, and pick up one or the other cleaning implements.

The problem with taping the handle to the bottle is that the brush handle is not as rigidly fixed to the bottle as necessary to adequately scrub the grout. Held on merely by tape, the brush has a tendency to wobble, twist or move relative to the bottle, especially in view of the soft, squeezable plastic of which the bottle is manufactured. Additionally, the brushes wear out, in particular, the bristles wear down and become irreparably misaligned and thus must be replaced after a number of hours of use. The tape must then be torn off the bottle and brush and a new brush put on and new tape applied. If a sufficient amount of tape is used to adequately hold the brush to the bottle, it becomes a difficult job to maintain the alignment of the brush and remove the tape to replace the brush.

SUMMARY OF THE INVENTION

Wherefore, it is an object of the present invention to overcome the above mentioned shortcomings and drawbacks associated with the prior art.

Another object of the present invention is to provide an integrated cleaning brush and fluid dispensing bottle system which facilitates the replacement of the brush when the brush wears out.

A further object of the present invention is to provide a combination brush and bottle which can be held in one hand of a worker and perform both a fluid dispensing and material scrubbing of any surface or object in substantially the same manual operation.

A yet still further object of the present invention is to provide a removable collar which attaches to the bottle and secures the brush to the bottle as single unit.

Another object of the present invention is to provide a quick release device which releases the collar from the bottle and the brush.

The present invention relates to a combination fluid dispensing bottle and scrubbing brush for cleaning and scrubbing virtually any surface or object. Such surfaces can range from household and commercial floors, walls, ceilings, desk tops and counters to detailing automobiles and cleaning auto parts or any object. Although described below with particularity with respect to cleaning and scrubbing of tile grout, it is to be appreciated that the described apparatus could be utilized for cleaning most anything.

The scrubbing brush is releasably secured to the bottle by a collar which has a first passage sized to be fit over and secured to a bottle cap covering the open spout of a plastic squeeze bottle, and a second passage sized to accept and secure a handle of a scrubbing brush in relative proximity to the sidewalls of the plastic bottle. The collar comprises a separable first and second clamping pieces which can be drawn together or spread apart, according to the operation of a quick release device, to respectively secure the brush to the bottle or release the brush therefrom. Also the fluid dispensing bottle and brush may be provided with communicating passageways in order to directly dispense the fluid from the bottle into direct proximity of the brush bristles.

BRIEF DESCRIPTION OF THE DRAWINGS

The invention will now be described, by way of example, with reference to the accompanying drawings in which.

DETAILED DESCRIPTION OF THE INVENTION

Figure 1:
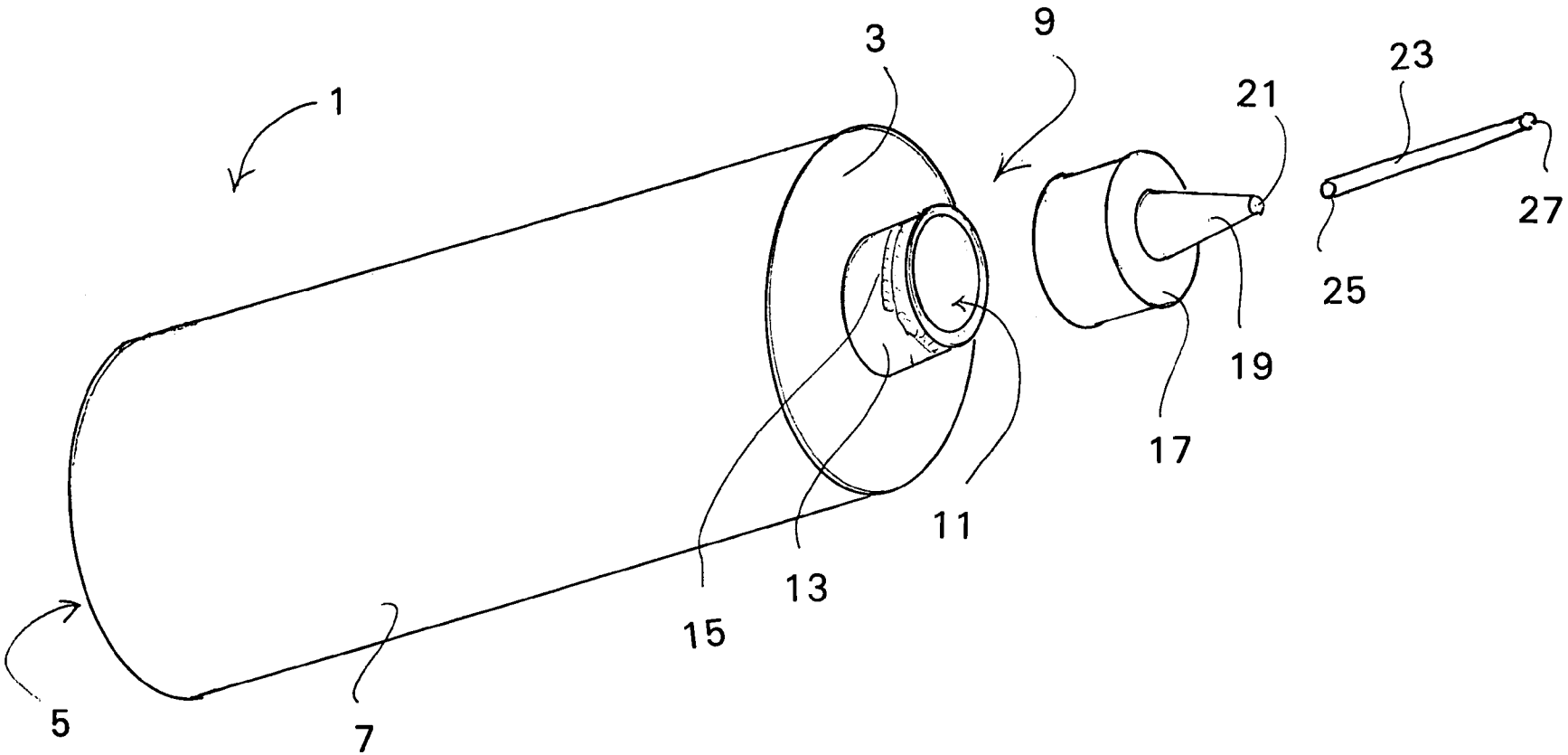
FIG. 1 is a perspective exploded view of a squeeze bottle cap, nipple and tube.

Observing FIG. 1, and as discussed in the Background of the Invention above, the present invention utilizes a bottle or container 1 having a top 3 and a bottom 5 and a sidewall 7 extending therebetween. The bottle 1 defines an interior cavity 9 for holding and dispensing cleaning solution (not shown) for use in cleaning a surface. By way of example of the present invention, the following description refers to tile grout as the surface for purposes of best understanding the use and function of the invention, however, it is to be appreciated that the described and disclosed cleaning implement can clean and scrub any surface.

The bottle 1 is generally a plastic or similarly constructed semi-rigid polymer bottle 1, wherein the sidewalls 7 are manually squeezable to dispense the cleaning solution which is contained therein. The cleaning solution, as is well known in the art, can be any number of liquid cleaning products as are well known in the marketplace for physically cleaning particular surfaces, i.e., tile grout, thus no further description is provided.

The bottle top 3 is provided with a spout 13 defining an opening 11 in the top 3 for receiving and dispensing liquid from the interior cavity 9 of the bottle 1. The spout 13 generally has a diameter smaller than that of the bottle itself in order to facilitate dispensing a desired amount of cleaning solution therefrom. The spout 13 may be provided with a cylindraceous thread 15 for receiving a mating cylindraceous thread 15 on a bottle cap 17. The cap 17 supports the mating cylindraceous threads 15 in such a manner that the bottle cap 17 may be screwed or snapped tightly to the bottle spout 13 in order to secure the cap 17 thereto.

The cap 17 is provided with a nozzle or nipple 19 usually in the form of a cone or truncated cone defining a nozzle opening 21 having a particularly smaller diameter than the opening 11 in the top 3 of the bottle 1. The nozzle opening 21 further facilitates dispensing of a desired amount of cleaning solution and at a desired rate from the bottle 1 when the bottle 1 is squeezed by a user.

Additionally, in order to clean or scrub certain hard to reach places where tile and tile grout may be found, it may also be necessary to provide an extension tube 23, or feed line, having a first end 25 which is either integrally formed with the nozzle 19, or has an outer diameter sized so as to frictionally fit within the nozzle opening 21, so as the first end 25 will fit generally inside the cap opening 11 defined in the nozzle or nipple 19 and thus be attached thereto. A second end 27 of the extension tube 23 can be left free and thereby extends the actual dispensing opening 11 of the bottle 1 to a point where it may be easier to reach, for instance, under or between cabinets to dispense the grout cleaner in the appropriate spot.

Figure 2:
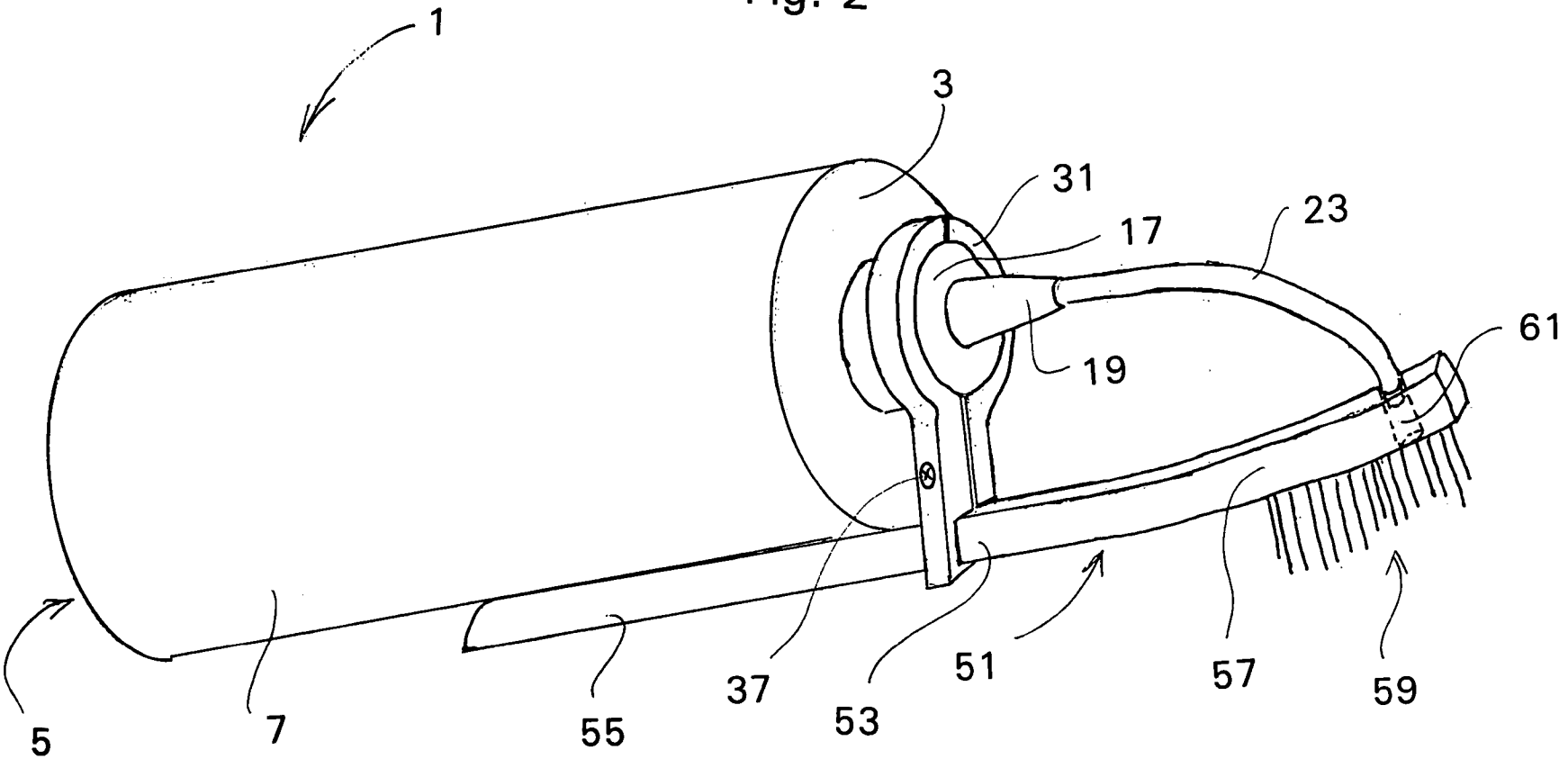
FIG. 2 is a perspective elevational view of a squeeze bottle, cap, nipple, tube and associated brush and supporting collar of the present invention.

Turning to FIG. 2, the bottle 1, bottle cap 17, nozzle 19, extension tube 23 are shown in conjunction with a clamp or collar 31 and a bristle brush 51 substantially defining the system of the present invention. By way of general explanation, with the bottle cap 17 secured to the spout 13 of the bottle 1 as shown, and the extension tube 23, either integrally formed with the nozzle 19 or communicating therewith as discussed above, the collar 31 is affixed to an outer surface portion of the bottle cap 17 and fastened securely thereto. The collar 31 may be secured in any manner as known in the art, but for purposes of one embodiment, a friction fit is utilized according to the clamping mechanism of the collar 31 to be described in further detail below. The brush 51 is also held by the collar 31 at an alignment substantially adjacent and parallel with the side wall 7 of the bottle 1. It is to be appreciated that the collar 31 holds the brush 51 in a substantially central portion 53 of the brush 51 to facilitate the user's grasping of a first handle portion 55 of the brush 51. The brush 51 is also provided with a brush head 57 having bristles 59 essentially radially with respect to the side wall 7 of the bottle 1 to an extent which facilitates scrubbing and cleaning operations, and which will be described in further detail below.

It is to be appreciated that the collar 31 is essentially a clamping device having an operative fastener, in this case, a screw or bolt 37, provided through a first half 33 and a second half 35 of the collar 31. The bolt 37 secures the first and second halves 33, 35 of the collar 31 to clamp tightly about the bottle cap 17 and also cooperatively secures the brush handle 55 to the extent that the brush handle 55 is immovable in any direction, either longitudinally, horizontally or radially, with respect to the bottle cap 17. Next, can be seen in this Figure, the extension tube 23 extends from the first end 25 connected with the nozzle 19 and is bent or curves along its length to an extent which permits the second free end of the nozzle 19 to be inserted into a passage or a hole 61 formed in the brush head 57. The passage or hole 61 in the brush head 57 extends completely therethrough and may communicate substantially with or adjacent a portion of the brush head 57 supporting the bristles 59.

The brush 51 is provided with the handle portion 55 spaced from, but contiguous with the head portion 57 and bristles 59. The bristles 59 of the present invention are substantially perpendicularly aligned to a longitudinal axis defined by the handle 55 and the brush 51 may look similar to a toothbrush or other types of known scrub brushes. The bristles 59 may be made of nylon material, wire, plastic or other material as known in the art, and the bristles 59 are often provided with substantially stiffer constitution than those of a toothbrush in order to facilitate the cleaning of certain porous and non-porous surfaces. The brush handle 55 may be straight or curved or of any particular shape which facilitates manually grasping thereof, the brush 51 may be, for instance, slightly curved at the head portion to facilitate cleaning and scrubbing of a surface.

The brush 51 can be designed with the passage 61 at a point anywhere along the length of the brush 51, however, in a preferred embodiment of the present invention, the throughhole is located substantially in conjunction and communication with the head portion of the brush head 57 which holds the bristles 59. As can be readily appreciated by one of ordinary skill in the art, when the cleaning solution is dispensed from the bottle 1 through the nozzle 19 and through the extension tube 23 and, hence, out the second end 27 of the tube 23 and onto the surface being cleaned, the cleaning solution exits the device through the passage 61 in the brush 57 and is positioned in immediate proximity with the scrubbing bristles 59 thus permitting both accurate and timely dissemination of the cleaning solution in the bottle 1 onto the surface being cleaned.

In another embodiment of the present invention, the extension tube 23 may be connected to a hollow handle which supplies the cleaning solution to the surface through at least one or even a plurality of throughholes or passages 61 along the handle 55. The plurality of passages 61 provided in the handle 55 could potentially be located more closely adjacent the head end and the bristles 59 of the brush 57.

Thus, in use with the scrubbing brush 51 held fast to the bottle 1 by the collar 31, and the extension tube 23 communicating between the interior of the bottle 1 and the brush head 57, a user need only utilize one hand to perform both a cleaning solution dispensing action, i.e., by squeezing the bottle 1, and a scrubbing action wherein the brush 51 is scrubbed or passed over the surface being cleaned at the same time. Thus, a worker using one hand, has excellent manual control over both the bottle 1 and the brush 51 in the same hand and may continuously or simultaneously apply both the scrubbing action of the bristles 59 and the cleaning fluid solution dispensing without changing hands or putting the bottle 1 or the brush 51 down and thus the cleaning of the grout or other surface is substantially more efficient.

Figure 3:
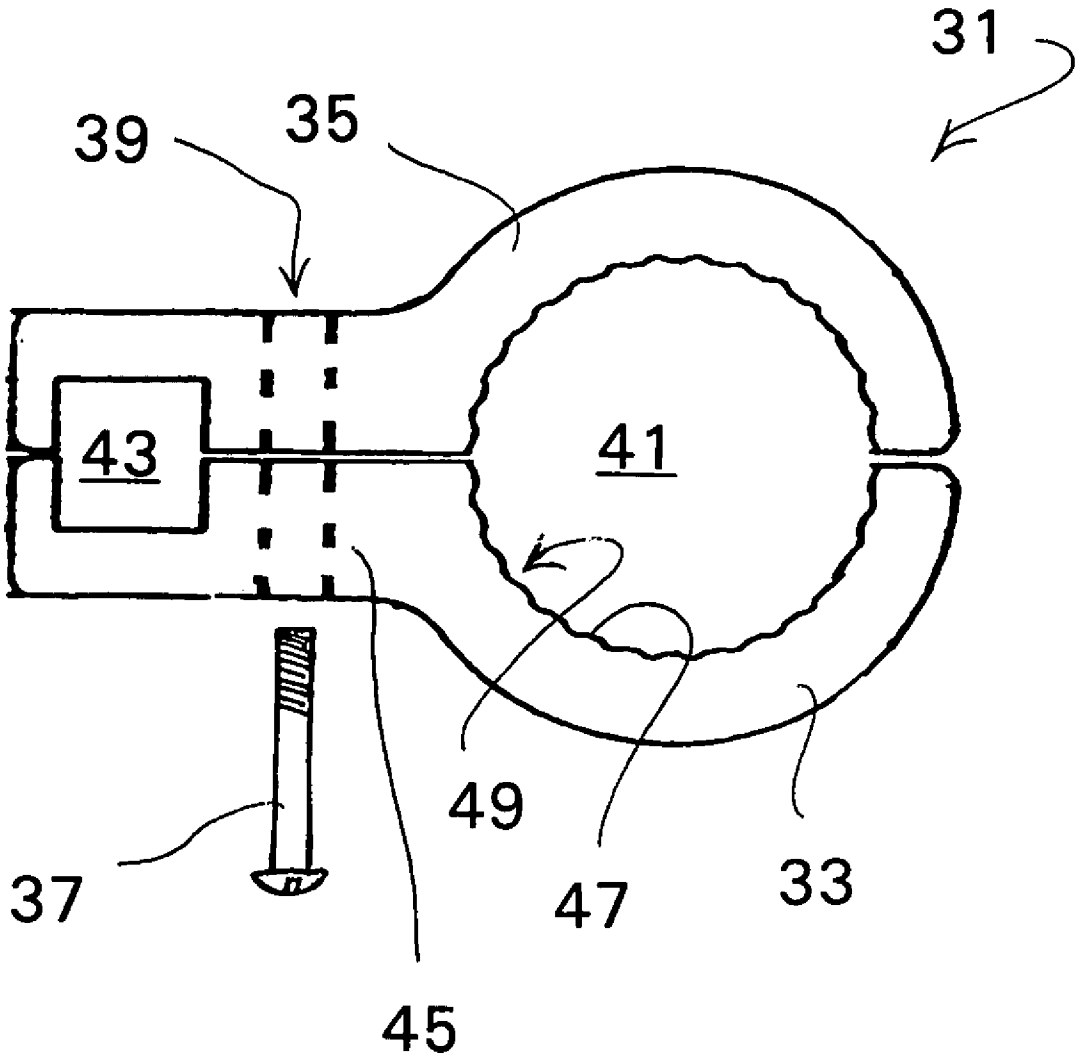
FIG. 3 is a planar view of the supporting collar and securing device.

FIG. 3 relates specifically to the collar 31 and clamping mechanism of the present invention. In a preferred embodiment of the present invention, the collar 31 is provided with the first half 33 and the second half 35 being separate and which may be adjustably connected by any known connecting means in the art. For purposes of example, the present specific embodiment shows a bolt received in a bolt receiver 39 in the collar 31. The first half 33 and the second half 35 of the collar 31 are substantially mirror images of one another and aligned adjacent one another in the appropriate position for engaging the bottle cap 17 and the brush 51. In this manner, the collar 31 defines a bottle engaging passage 41 and a brush grasping portion 43 spaced therefrom by an intermediate portion 45 provided between the bottle cap grasping portion and the brush grasping portion 43.

The bolt receiver 39 is positioned in the intermediate portion 45 of the collar 31 and passes through, or at least partially through, both the first half 33 and the second half 35 in order to provide for the bolt extending between both the first half 33 and the second half 35 of the collar 31. The receiver portions in both the first half 33 and the second half 35 of the collar 31 may be tapped with threads, or in certain cases only the second half 35 receiver portion need be threaded so that the first and second halves 33, 35 of the collar 31 may be secured together by the bolt. Thus, it can be readily appreciated, when the bolt is tightened the first half 33 and the second half 35 of the clamp 31 are drawn more closely together whereas upon loosening the bolt, the first half 33 and the second half 35 are permitted to spread apart in order to facilitate the grasping and the release, respectively, of both the bottle cap 17 and the brush 51.

Because brush handles 55 tend to be substantially square or rectangular in shape, the brush grasping portion 43 is provided having a substantially square profile in order to facilitate the support of the brush 51 with respect to the bottle 1. Similarly, as the bottle caps 17 or spout 13 of a bottle 1 or even the bottle itself are generally round, the bottle 1 grasping passage of the collar 31 is provided with substantially round profile defined by a contact surface 47, and may also have a series of notches or grooves 49 extending axially therethrough in order to better frictionally grasp the outer wall of the bottle cap 17. It is to be appreciated that the brush grasping portion 43 and the bottle engaging passage 41 could be other conforming shapes as is necessary.

In order to utilize the device of the present invention, the collar 31 is initially in a loosened state such that the bottle grasping passage 41 is spread wide enough to accept the bottle cap 17 there through. Once the collar 31 is positioned over the outer surface of the bottle cap 17, and before it is tightened thereto, the brush 51 may be inserted into the brush grasping portion 43 so as position the passage or hole 61 in the brush 51 in proximity with the second end 27 of the extension tube 23. Once the brush 51 is aligned adjacent the sidewall 7 of the bottle 1, i.e., at both the appropriate axial and radial position relative to the bottle 1, the bolt is tightened to secure the collar 31 to the bottle cap 17. With the bottle cap 17 on the spout 13 of the bottle 1 and the collar 31 secured thereto, and with the brush 51 secured relative thereto in the brush grasping portion 43 of the clamp 31, the second end 27 of the extension tube 23 is then engaged with the throughbore or passage 61 in the head portion of the brush 51. As can be appreciated, the brush 51 is held in both a securely, radially and axially held with respect to the bottle 1 and any clean liquid dispensed from the bottle 1 will now pass through the nozzle extension tube 23 and into the passage 61 in the brush handle 55 to be dispensed substantially adjacent the bristles 59. Thus, the brush is securely held relative to the bottle 1 such that no matter what kind of force or motion is applied to the scrubbing bristles 59 of the brush, the brush and the bottle 1 essentially move together.

It is also to be appreciated that the bristles 59 of a brush wear out after a certain period of time, for instance, after a day, 24- or even 48-hours of use, because the bristles 59 wear or deteriorate due to both the cleaning solution and the force applied to the bristles 59 during scrubbing operations. These bristles 59, and hence the brush 51, must be replaced from time to time. The present invention simplifies the process by permitting the screw or bolt 37 to be slightly loosened and thus allow the used brush handle 55 to be released by the brush grasping portion 43 of the clamp 31. With the extension tube 23 removed from the passage 61 in the brush, the used brush may be removed and a new brush, having fresh bristles 59, may be inserted therein and the clamp 31 retightened to secure the new brush to the bottle 1. Finally, the extension tube 23, due to the nature of the substantially resilient material from which it can be made, is bent and inserted in the passage 61 through the brush and cleaning may be continued.

Also, it is important to note that the inter-changeability of the brush 51 would facilitate the use of a different brush where necessary to clean other surfaces or objects. The brush head portion 57 could be formed in most any shape, and support bristles 59 also aligned in any shape as desired for cleaning a particular surface while still permitting the dispensing of the cleaning solution. For instance, a triangular configuration of bristles (not shown) supported on a triangular shaped brush head 57 would facilitate the cleaning of corners, or angles between a surface and any adjacent surfaces. Thus, the inter-changeability of brush head shapes and sizes, along with different bristles and bristle configurations permits a substantially infinite ability for cleaning different surfaces or objects.

In another embodiment of the present invention, the bottle 1 and brush 51 could also be utilized for not merely cleaning a surface but sealing, painting or coloring a desired surface. In the context of tile grout for example, it is often advantageous to stain or color the grout a new or different color for purposes of aesthetics. The staining or coloring solution contained in the bottle 1 would be dispensed via the brush head 51, and the bristles 59 would apply and spread the coloring solution into the tile grout, thus changing the color of the tile grout. Also, due to the porous nature of the tile grout the grout is often sealed with a sealing solution which could also be dispensed and applied to the tile grout as described above with respect to cleaning solution and coloring of the grout.

Since certain changes may be made in the above described cleaning apparatus and method for making a grout cleaning apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A cleaning system comprising:

a bottle for holding a cleaning fluid, a brush for cleaning a desired surface being removably affixed to the bottle by a collar having a bottle attaching portion and a brush securing portion;

wherein the bottle, brush and collar are assembled and secured together, the collar affixes the brush to the bottle to produce an integral fluid dispensing and scrubbing unit; and wherein the bottle attaching portion of the collar defines a first passage sized to securely grasp an outer surface of a bottle cap, and the brush securing portion of the collar is attached to a handle of the brush, and the collar is divided into a first half and a second half along a longitudinal mating axis and a quick release mechanism is provided for releasably securing the first half and the second half together.

2. The cleaning system as set forth in claim 1, further including a communicating passage between the bottle and the brush to facilitate the direct application of the fluid to a desired surface through the brush.

3. The cleaning system as set forth in claim 2, wherein the communicating passageway comprises a tube extending from the bottle into an orifice in a handle of the brush.

4. The cleaning system as set forth in claim 3, wherein the orifice in the brush handle is positioned substantially within a bristle portion of the brush.

5. The cleaning system as set forth in claim 3, wherein the second passage in the collar is spaced from the first passage in the collar by an intermediate portion of the collar to align the brush handle immediately adjacent a sidewall of the bottle.

6. The cleaning system as set forth in claim 1, further comprising a bottle cap for removably covering a spout on the bottle, and a nipple formed integrally with the bottle cap defining an opening for dispensing a fluid contained in the bottle in a desired location.

7. The cleaning system as set forth in claim 1, wherein the quick release mechanism is a threaded bolt extending through the first half and into a threaded receiver formed in the second half of the of the collar.

* * * * *